United States Patent [19]

Bauer et al.

[11] 4,218,054

[45] Aug. 19, 1980

[54] APPARATUS FOR FEEDING SHEETS TO IONOGRAPHY IMAGING CHAMBERS

[75] Inventors: Walter Bauer, Munich; Heinz Kröbel, Taufkirchen; Jürgen Müller, Munich, all of Fed. Rep. of Germany

[73] Assignee: AGFA-Gevaert, A.G., Leverkusen, Fed. Rep. of Germany

[21] Appl. No.: 866,036

[22] Filed: Dec. 30, 1977

[30] Foreign Application Priority Data

Jan. 13, 1977 [DE] Fed. Rep. of Germany ..... 2701201

[51] Int. Cl.[2] ..... B65H 3/46

[52] U.S. Cl. ..... 271/11; 271/106

[58] Field of Search ..... 271/11, 100, 101, 106, 271/104

[56] References Cited

U.S. PATENT DOCUMENTS

| | | | |
|---|---|---|---|
| 1,554,429 | 9/1925 | Hasselquist | 271/106 |
| 1,794,843 | 3/1931 | Freeman | 271/106 |
| 2,185,652 | 1/1940 | Spiess | 271/106 X |
| 2,883,190 | 4/1959 | Manthey | 271/106 |

FOREIGN PATENT DOCUMENTS

| | | | |
|---|---|---|---|
| 702651 | 2/1941 | Fed. Rep. of Germany | 271/106 |

*Primary Examiner*—Richard A. Schacher

*Attorney, Agent, or Firm*—Peter K. Kontler

[57] ABSTRACT

Apparatus for feeding dielectric receptor sheets and/or sheet-like carriers for receptor sheets to the ionography imaging chamber of a radiographic system from a nearly upright stack of overlapping sheets has a set of suction heads which are mounted on a first lever pivotally mounted on a second lever. The first lever is pivoted relative to the second lever to thereby move the suction heads, which attract the upper marginal portion of the outermost sheet of the stack, along an arcuate path to flex the upper marginal portion away from the neighboring sheet. The second lever is thereupon pivoted to complete the separation of the outermost sheet from the neighboring sheet and to introduce the upper marginal portion of the separated sheet into the nip of advancing rolls which transport the sheet into the inter-electrode gap of the imaging chamber. A hold-down device abuts against the outer side of the outermost sheet below the suction heads during flexing of the upper marginal portion of the outermost sheet.

13 Claims, 4 Drawing Figures

APPARATUS FOR FEEDING SHEETS TO IONOGRAPHY IMAGING CHAMBERS

BACKGROUND OF THE INVENTION

The present invention relates to sheet feeding apparatus in general, and more particularly to improvements in apparatus for removing discrete sheets from a pile or stack of registering sheets. Still more particularly, the invention relates to improvements in sheet feeding apparatus which can be utilized with advantage for singularizing and otherwise manipulating successive sheets of a pile or stack wherein the neighboring sheets exhibit a pronounced tendency to adhere to each other, especially as a result of electrostatic charges. Typical examples of such sheets are dielectric receptor sheets which are used for exposure to object-modulated X-rays in the gas-filled interelectrode gap of an ionography imaging chamber. The invention also relates to a radiographic system which embodies the improved sheet feeding apparatus.

In many presently known radiographic systems which employ ionography imaging chambers, the dielectric receptor sheets and sheet-like carriers therefor consist of polyester or the like. A radiographic system which employs such sheets is disclosed, for example, in commonly owned copending application Ser. No. 693,912 filed June 8, 1976 by Pfeifer et al., now U.S. Pat. No. 4,061,915 granted Dec. 6, 1977, to which reference may be had, if necessary. The arrangement which is disclosed in the application of Pfeifer et al. employs several trays for differently dimensioned dielectric receptor sheets and a further tray for sheet-like flexible carriers consisting of polypropylene. The receptor sheets as well as the carriers are elastically deformable but relatively stiff and the receptor sheets are highly sensitive, i.e., their surfaces are likely to be scratched or otherwise damaged in response to shifting of neighboring sheets relative to each other. In other words, removal of sheets from the respective stacks should be carried out with utmost care, preferably with a minimum of sliding movement of neighboring sheets with respect to each other. In fact, it is even desirable to avoid placing a substantial weight on any of the sheets in a stack. Furthermore, it is desirable or advantageous to avoid the use of suction heads, cups or like sheet attracting devices wherein the pressure of air is very low because strong adherence of a suction cup to a sheet is likely to damage its sensitive surface. This evidently conflicts with the need for reliable singularization of sheets, i.e., with the need to insure that sheets are removed individually rather than in groups of two or more. Therefore, presently known sheet feeding apparatus are not satisfactory or are not sufficiently satisfactory for reliable removal of individual dielectric receptor sheets or the like from a pile or stack.

OBJECTS AND SUMMARY OF THE INVENTION

An object of the invention is to provide a novel and improved sheet feeding apparatus, especially an apparatus which can be used for singularizing of sheets which are about to be fed to the ionography imaging chamber of a radiographic system.

Another object of the invention is to provide an apparatus which is particularly suited for the feeding of sheets with a minimum of relative movement between neighboring sheets of a pile or stack from which the sheets are removed.

A further object of the invention is to provide a sheet feeding apparatus which is especially suited for separation of sheets tending to adhere to each other under the influence of static electricity.

An additional object of the invention is to provide a sheet feeding apparatus wherein the stacks of sheets to be singularized are held and supported in such a way that the weight upon each sheet of the stack is very low and that the positioning of the pile or stack further contributes to convenience and reliability of separation and further manipulation of successive sheets.

Another object of the invention is to provide the feeding apparatus with novel and improved means for effecting initial (partial) separation of successive sheets of a stack from the neighboring sheets.

An ancillary object of the invention is to provide the apparatus with novel and improved means for supporting one or more suction cups or like sheet attracting devices which are used to contact successive sheets of the stack for the purpose of transferring them to a different location, particularly into the range of means for advancing the sheets into the interelectrode gap of an ionography imaging chamber.

One feature of the invention resides in the provision of an apparatus for singularizing and transporting successive outermost sheets of a stack of overlapping sheets, particularly for feeding discrete sheets to the ionography imaging chamber of a radiographic system. The apparatus comprises a support (e.g., a horizontal shaft), a first transfer member (e.g., a lever) which is mounted on the support and is movable (preferably pivotable) between first and second end positions in which the transfer member is respectively nearer to and more distant from the outermost sheet of the stack, a second transfer member (e.g., a second lever), a post and a bearing sleeve or analogous means for turnably mounting the second transfer member on the first transfer member for movement between a first position and a second position, at least one suction head or another suitable sheet attracting member mounted on the second transfer member and being adjacent to and attracting a marginal portion of the outermost sheet of the stack in the first position of the second transfer member (the attracting member moves along an arcuate path away from the stack in response to movement of the second transfer member from the first to the second position whereby the marginal portion of the outermost sheet is folded away from the neighboring sheet of the stack), means for moving the second transfer member between the first and second positions, and means for moving the first transfer member (together with the second transfer member) from the first to the second end position while the second transfer member is out of the first position (preferably in the second position) whereby the first transfer member completes the separation of outermost sheet from the neighboring sheet of the stack.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 4:
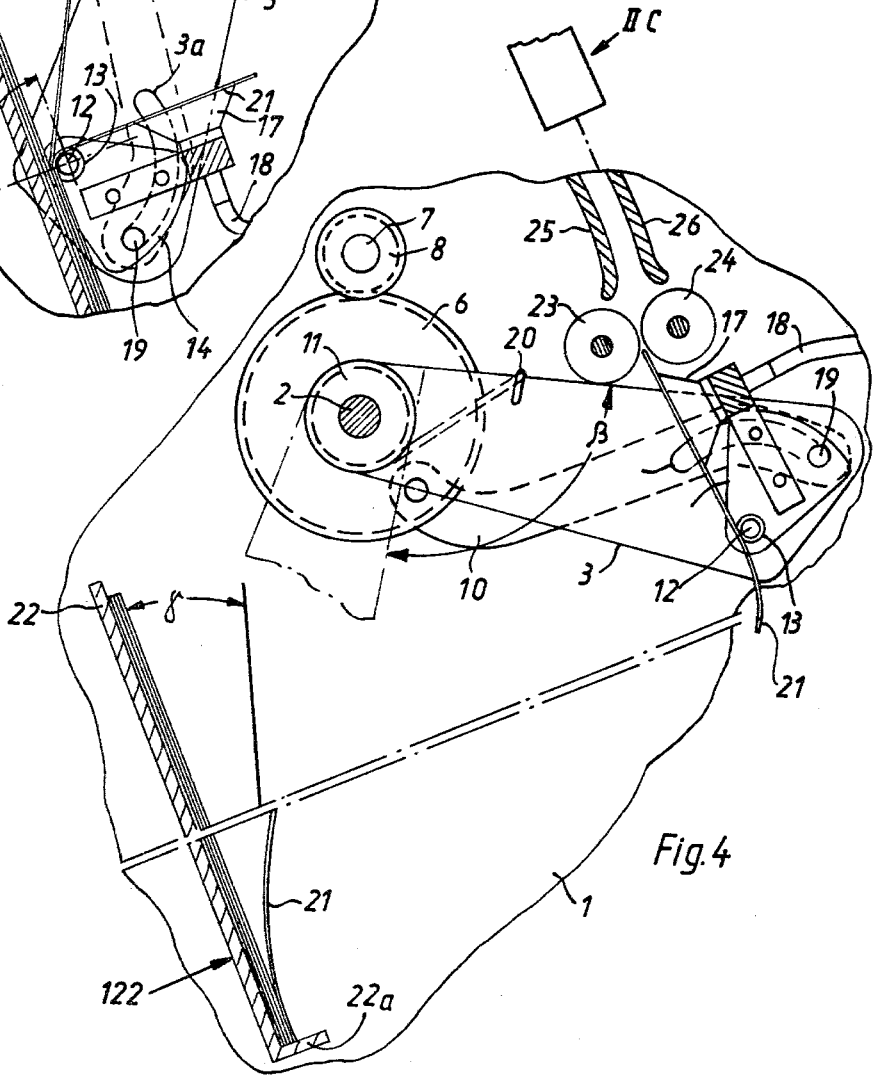
FIG. 4 illustrates the structure of FIG. 3, with the outermost sheet of the stack practically fully separated from the neighboring sheet and about to be entrained into the interelectrode gap of an ionography imaging chamber.

The drawing shows a sheet feeding apparatus which comprises a receptacle or tray 122 for a supply of stack 121 of sheets 21. The tray comprises an inclined side wall 22 and a relatively short bottom wall 22*a* (FIG. 4). The lower edges of the sheets 21 rest on the bottom wall 22*a* and the innermost sheet of the stack 121 leans against the side wall 22. The inclination of the side wall 22 with respect to a vertical plane is relatively small (the angle gamma shown in FIG. 4 is preferably close to 30 degrees) which insures that the weight of the stack 121 is borne primarily by the bottom wall 22*a* and that the pressure of sheets against each other and against the side wall 22 is relatively low.

The tray 122 is disposed between two plate-like frame members 1 (only one shown) for a horizontal shaft 2 serving as a support for two pivotable transfer members or levers 3, one at each side of the stack 121 of sheets 21 on the bottom wall 22*a*. The frame members 1 are provided with bearing sleeves 4 for the respective end portions of the shaft 2, and the latter is held against axial movement by split rings 5. A driving gear 6 is coaxially secured to the shaft 2 adjacent to the inner side of one of the frame members 1 and meshes with a second gear 8 on an oscillatable shaft 7 which is driven by a reversible gear motor or another suitable prime mover 108 capable of rotating the gear 8 back and forth through angles of preselected magnitude. The gear 6 carries an eccentrically mounted pin 9 which constitutes a pivot member for the upper end portion of a motion transmitting link 10.

The shaft 2 further carries two sleeves 11 (only one shown). The illustrated sleeve 11 is partially recessed into the inner side of the driving gear 6 and serves as a bearing for the respective lever 3. It will be noted that the lever 3 which is shown in the drawing is not directly connected to the gear 6. That portion of the lever 3 which is remote from the shaft 2 carries a post 12 for a bearing sleeve 13 mounting a second transfer member or lever 14 which is turnable about the axis of the post 12, i.e., relative to the lever 3. The lever 14 is riveted to the respective end portion of a traverse 16 constituting a holder for one or more sheet attracting devices here shown as suction heads 17 which contact the outer side of the outermost sheet 21 when the lever 3 assumes the end position shown in FIG. 1. The suction head or heads 17 are connected to the intake of a suitable suction pump (not shown) by a flexible conduit 18.

That end portion of the link 10 which is remote from the post 9 is articulately connected with the lever 14 by a pin 19 which extends into an elongated arcuate guide groove 3*a* of the lever 3. The groove 3*a* of the lever 3 confines the lever 14 to pivotal movement between the positions of FIGS. 1 and 3. The surfaces at the ends of the groove 3*a* determine the extent of pivotal movement of the lever 14, holder 16 and suction head or heads 17 relative to the lever 3. Such pivotal movement is imparted to lever 14 by the link 10.

Figure 1:
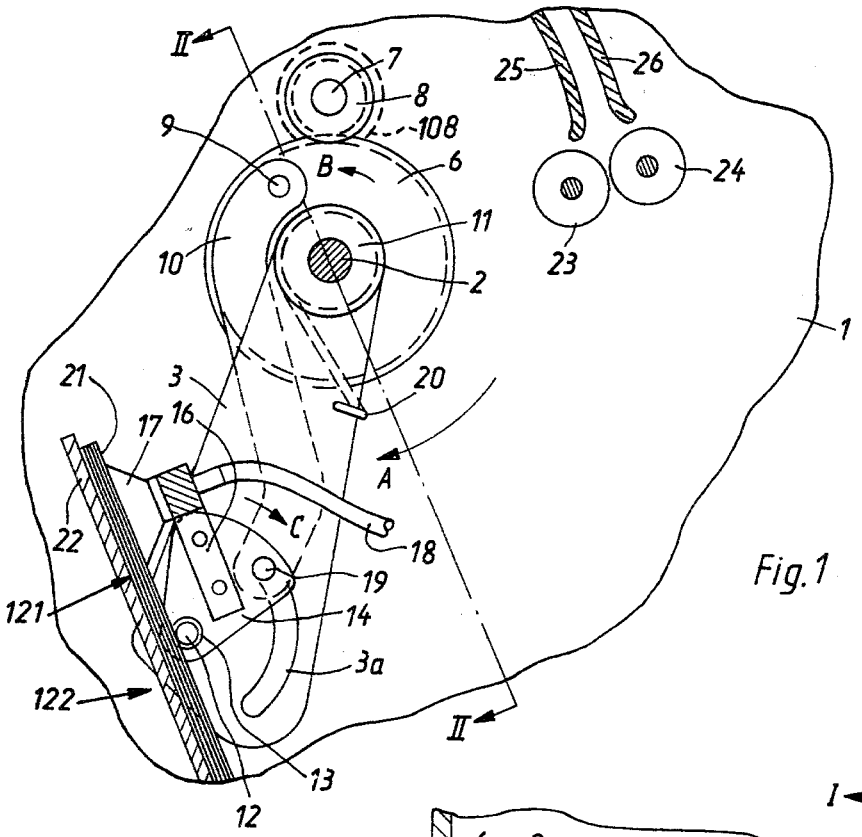
FIG. 1 is a fragmentary sectional view of a sheet feeding apparatus which embodies the invention, the section being taken in the direction of arrows, as seen from the line I—I of FIG. 2, and the outermost sheet of a stack of sheets being shown in the position it assumes prior to flexing of its upper marginal portion away from the neighboring sheet.
Figure 2:
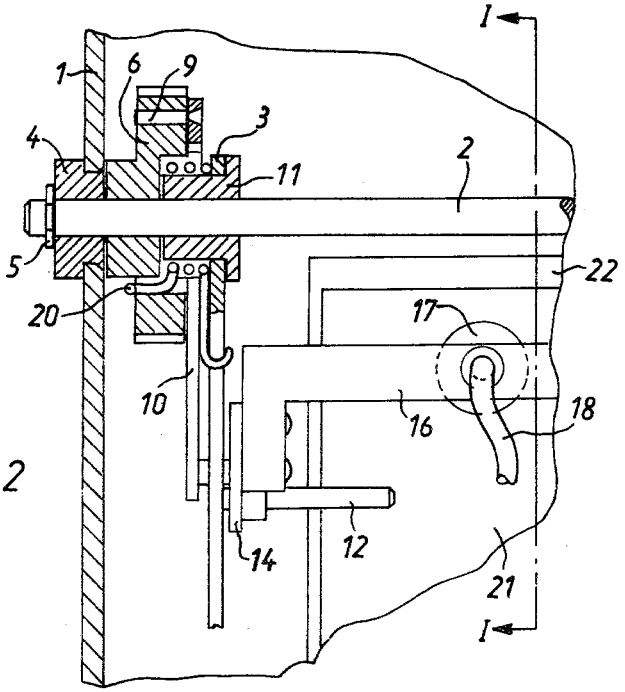
FIG. 2 is a fragmentary sectional view as seen in the direction of arrows from the line II—II of FIG. 1.

A torsion spring 20 is provided to yieldably bias the lever 3 in a clockwise direction, as viewed in FIG. 1, i.e., to urge the suction head or heads 17 toward the upper marginal portion of the outermost sheet 21 of the stack 121 on the bottom wall 22*a*. The direction in which the lever 3 can turn to its first end position under the action of the spring 20 is indicated by the arrow A. When the driving gear 6 assumes the angular position of FIG. 1, the spring 20 is free to maintain the post 12 in abutment with the exposed side of the outermost sheet 21 at a level somewhat below the upper edge of such sheet. FIG. 2 shows that the post 12 extends inwardly of and well beyond the lever 14 so that it can constitute a hold-down device which engages a substantial portion of the exposed side of the outermost sheet 21. This post enables the suction head or heads 17 to flex or fold the upper marginal portion of the outermost sheet 21 about a horizontal axis when the lever 14 is pivoted in the direction indicated by arrow C, i.e., from the (first) position of FIG. 1 to the (second) position shown in FIG. 3. Prior to moving from the position of FIG. 1, the open end of each suction head 17 lies flush against the outermost sheet 21 at a level above the post 12. It is not absolutely necessary that the hold-down device constitute or form part of the post (mounting means) 12 for the lever 14. However, it is preferred to place the hold-down device close to or into immediate proximity of the pivot axis of the lever 14.

Figure 3:
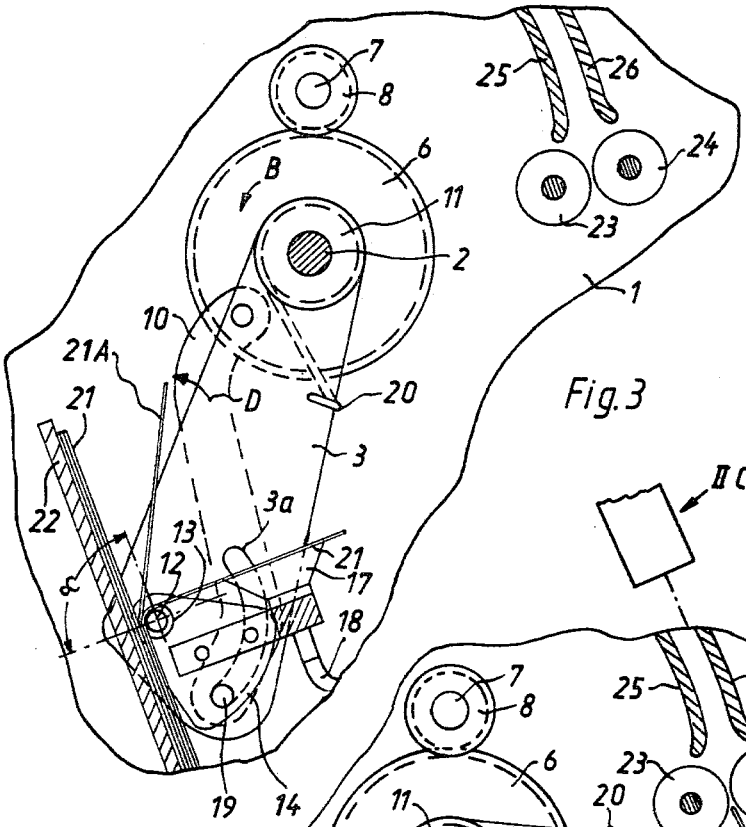
FIG. 3 illustrates the structure of FIG. 1, with the outermost sheet shown in a position it assumes upon completion of partial separation of its upper marginal portion from the neighboring sheet of the stack.

The means for moving the lever 14 between the positions of FIGS. 1 and 3 includes the parts 108, 7, 8, 6, 10 and 19. The means for moving the lever 3 from the end position of FIG. 3 to the end position of FIG. 4 is the pin 19, i.e., a component or part of the means for moving the lever 14.

The operation is as follows:

The lever 3 is assumed to dwell in the first end position of FIG. 1 and the driving gear 6 is held in that angular position in which the link 10 maintains the lever 14 in the (first) position of FIG. 1, i.e., the suction head or heads 17 lie flush against the upper marginal portion of the outermost sheet 21. A valve or the like establishes connection between the intake of the aforementioned suction pump and the conduit or conduits 18 so that each suction head 17 attracts the adjacent marginal portion of the outermost sheet 21. The prime mover 108 for the gear 8 thereupon rotates the shaft 7 in a clockwise direction, as viewed in FIG. 1, so that the gear 6 is rotated in the (counterclockwise) direction indicated by arrow B and the link 10 pivots the lever 14 clockwise (arrow C). The angle alpha (shown in FIG. 3) through which the lever 14 turns clockwise relative to the lever 3 is approximately 90 degrees. Such angular movement of the lever 14 (relative to the lever 3) is terminated when the pin 19 enters the lower end of the guide slot 3*a*. The holder 16 and the suction head or heads 17 share the movement of the lever 14 so that the upper marginal portion of the outermost sheet 21 is pivoted about the horizontal axis defined by the hold-down post 12. It has been found that, even if the electrostatic force which causes two neighboring sheets 21 to adhere to each other is quite pronounced, the upper marginal portion of the outermost sheet is readily separated from the upper marginal portion of the adjacent sheet when the lever 14 is pivoted through the angle alpha. In some instances, the adjacent sheet will participate in initial movement of the upper marginal portion of the outermost sheet 21 to the position of FIG. 3; however, it becomes separated and returns into a position of parallelism with the inclined side wall 22 well before the upper marginal portion of the outermost sheet reaches the position of FIG. 3. Reliable separation of the upper marginal portion of outermost sheet 21 from the upper marginal portion of the adjacent (next-to-the-outermost) sheet is practically certain if the sheets are relatively stiff (this is the case with sheets which constitute dielectric receptors for introduction into the interelectrode gap of an ionography imaging chamber). FIG. 3 shows the upper marginal portion 21A of the next-to-the-outermost sheet 21 in or close to a position of maximum flexure. This upper marginal portion is in the process of returning to a position of parallelism with the remaining sheets of the stack 121 (arrow D). Thus, flexing of the upper marginal portion of the outermost sheet 21 through the angle alpha insures that this critical part of the outermost sheet is invariably separated from the adjacent portion 21A of the next sheet, even if the attraction between neighboring sheets is very pronounced. Thus, even if the marginal portion 21A adheres to the upper marginal portion of the outermost sheet 21, it is invariably separated from the outermost sheet before the lever 14 reaches the position of FIG. 3 because the portion 21A is not directly attracted by a suction head.

FIG. 2 shows that one end portion of the torsion spring 20 is anchored in the gear 6 and that the helices of the spring surround the bearing sleeve 11. The spring 20 stores energy while the gear 6 pivots the lever 14 clockwise through the medium of the link 10. When the pin 19 assumes the position of FIG. 3, the lever 3 is compelled to share the (counterclockwise) angular movement of the gear 6 (in the direction indicated by arrow B) and moves to the end position of FIG. 4. The angle beta which denotes the extent of angular movement of the lever 3 between the two end positions preferably equals or approximates the angle alpha, i.e., the extent of angular movement of the lever 14 relative to the lever 3. The movement of lever 3 from the end position of FIG. 3 to the end position of FIG. 4 results in placing of the upper marginal portion of the thus completely removed (or practically completely removed) outermost sheet 21 into the range of two advancing rolls 23, 24 which feed the sheet into a channel defined by two arcuate guide members 25, 26. The sheet which enters such channel is introduced into the interelectrode gap of the ionography imaging chamber (schematically shown in FIG. 4, as at IIC).

The feature that the angle beta equals or approximates the angle alpha is desirable because counterclockwise pivoting of the lever 3 about the axis of the shaft 2 results in flexing of the outermost sheet 21 counter to the direction in which the sheet was flexed during clockwise movement of lever 14 from the position of FIG. 1 to the position of FIG. 3. Thus, the sheet 21 which enters the nip of the advancing rolls 23, 24 is again flat and can readily enter the channel between the guide members 25, 26. Since the sheets 21 are assumed to be reasonably stiff, such "unflexing" of the outermost sheet results in practically complete separation from the adjacent sheet of the stack without any sliding movement, i.e., the likelihood of scratching of or other damage to those sides of the outermost sheet and the adjacent sheet which face each other is practically nil.

The aforediscussed inclination of the side wall 22 of the tray 122 (angle gamma of approximately 30 degrees) also reduces the likelihood of defacing the sheets 21 during transfer from the tray into the nip of the advancing rolls 23, 24. Thus, and as already mentioned above, the weight of the stack 121 of sheets 21 rests almost exclusively on the bottom wall **22*a* and the inclination of the side wall 22 is desirable primarily to insure that the sheets of a stack resting of the bottom wall 22*a* remain parallel to the plane of the side wall 22. An angle (gamma) of approximately 30 degrees has been found to be highly satisfactory when the tray 121 receives conventional polyester dielectric receptor sheets 21**.

The manner in which a sheet 21 which enters the gas-filled interelectrode gap of the chamber IIC is exposed to object-modulated X-rays to receive a latent image, and the manner in which the latent image is thereupon converted into a visible image by resorting to a liquid developing agent or to toner particles and a fusing device forms no part of the present invention. Reference may be had to the aforementioned commonly owned copending application Ser. No. 693,912 to Pfeifer et al.

An important advantage of the improved apparatus is its simplicity. For example, the moving means for the transfer levers 3 and 14 need not employ complex cams or other expensive and/or bulky components. A single reversible prime mover (108) suffices to transmit torque for movement of the lever 14 in two directions and for movement of the lever 3 to the end position of FIG. 4. The spring 20 automatically returns the lever 3 to end position of FIGS. 1 and 3 when the prime mover 108 is actuated to rotate the gear 6 clockwise.

Another important advantage of the improved apparatus is that the hold-down post 12 enables the suction head or heads 17 to flex identical (upper marginal) portions of successive sheets 21. This contributes to predictability of initial separation of each outermost sheet from the neighboring sheet. The post 12 which forms part of means for mounting the lever 14 on the lever 3 constitutes a simple but highly reliable hold-down device for successive outermost sheets. Of course, it is also possible to employ additional and/or different hold-down devices, for example, a roll or shaft which is automatically moved against the outer side of the outermost sheet 21 on the bottom wall **22*a* when the gear 6 begins to rotate the lever 14 clockwise through the medium of the link 10 and pin 19**.

A further important advantage of the improved apparatus is that, while moving from the end position of FIG. 3 to the end position of FIG. 4, the lever 3 pivots counterclockwise, i.e., counter to the direction of pivoting of the lever 14 during movement from the position of FIG. 1 to the position of FIG. 3. This results in a straightening or flattening of the sheet 21 which is about to enter the nip of the advancing rolls 23 and 24 to be introduced into the chamber IIC via channel between the guide members 25 and 26. Moreover, and also because the angle alpha equals or approximates the angle beta, the lower part of the outermost sheet 21 is separated from the neighboring sheet without any (or almost without any) sliding movement to thus insure that the sensitive surfaces of the sheets are not scratched or otherwise damaged during transfer into the range of the advancing rolls 23 and 24. Such separation of lower parts of outermost sheets, without any sliding movement relative to the neighboring sheets, will be practically automatic if the sheets are relatively stiff, i.e., if they exhibit a reasonably pronounced tendency to reassume a flat shape after flexing by the suction head or heads 17 during movement of the lever 14 from the position of FIG. 1 to that of FIG. 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for singularizing and transporting successive outermost sheets of a stack of overlapping sheets, particularly for feeding discrete sheets to the ionography imaging chamber of a radiographic system, comprising a support; a first transfer member mounted on said support and pivotable between first and second end positions, in which said first transfer member is respectively nearer to and more distant from the outermost sheet of the stack, through a first angle; a second transfer member; means for turnably mounting said second transfer member on said first transfer member for movement between a first position and a second position through a second angle which at least approximates said first angle; at least one sheet attracting member mounted on said second transfer member and being adjacent to and attracting a marginal portion of the outermost sheet of the stack in the first position of said second transfer member, said attracting member moving along an arcuate path away from the stack in response to movement of said second transfer member to said second position whereby the marginal portion of the outermost sheet is flexed in a direction away from the neighboring sheet of the stack; means for moving said second transfer member between said first and second positions; means for moving said first transfer member, together with said second transfer member, from said first to said second end position while said second transfer member is out of said first position, whereby said first transfer member completes the separation of the outermost sheet from the neighboring sheet of the stack; and advancing means for successive sheets of the stack, the marginal portion of the sheet which is engaged by said attracting member in said second end position of said first transfer member being located in the range of said advancing means.

2. Apparatus as defined in claim 1, wherein said sheet attracting member comprises at least one suction head.

3. Apparatus as defined in claim 1, wherein said first transfer member comprises means for confining said second transfer member to movement between said first and second positions.

4. Apparatus as defined in claim 1, further comprising means for yieldably biasing said first transfer member to said first end position.

5. Apparatus as defined in claim 1, wherein said means for moving said first transfer member from said first to said second end position constitutes a portion of said means for moving said second transfer member.

6. Apparatus as defined in claim 1, further comprising advancing means for successive sheets of the stack, the marginal portion of the sheet which is engaged by said attracting member in said second end position of said first transfer member being located in the range of said advancing means.

7. Apparatus as defined in claim 1, wherein said first transfer member pivots in a first direction during movement from said first to said second end position and said second transfer member turns in the opposite direction during movement from said first to said second position.

8. Apparatus as defined in claim 1, further comprising a receptacle for the stack, said receptacle comprising means for maintaining the sheets of the stack in positions of slight inclination with respect to a vertical plane, each sheet of the stack in said receptacle having an upper marginal portion and said attracting member being adjacent to the upper marginal portion of the outermost sheet in the first end position of said first transfer member while said second transfer member dwells in said first position thereof.

9. Apparatus as defined in claim 8, wherein the sheets of the stack in said receptacle and said vertical plane make an angle of approximately 30 degrees.

10. Apparatus for singularizing and transporting successive outermost sheets of a stack of overlapping sheets, particularly for feeding discrete sheets to the ionography imaging chamber of a radiographic system, comprising a support; a first transfer member mounted on said support and pivotable about a predetermined axis between first and second end positions in which said first transfer member is respectively nearer to and more distant from the outermost sheet of the stack; a second transfer member; means for turnably mounting said second transfer member on said first transfer member for movement between a first position and a second position; at least one sheet attracting member mounted on said second transfer member and being adjacent to and attracting a marginal portion of the outermost sheet of the stack in said first position of said second transfer member, said attracting member moving along an arcuate path away from the stack in response to movement of said second transfer member to said second position whereby the marginal portion of the outermost sheet is flexed in a direction away from the neighboring sheet of the stack; means for moving said second transfer member between said first and second positions, including a rotary driving element coaxial with said first transfer member and a link having a first portion articulately connected to said driving element at a locus remote from said axis and a second portion articulately connected to said second transfer member at a locus remote from said mounting means; and means for moving said first transfer member, together with said second transfer member, from said first to said second end position while said second transfer member is out of said first position, whereby said first transfer member completes the separation of the outermost sheet from the neighboring sheet of the stack.

11. Apparatus for singularizing and transporting successive outermost sheets of a stack of overlapping sheets, particularly for feeding discrete sheets to the ionography imaging chamber of a radiographic system, comprising a support; a first transfer member mounted on said support and movable between first and second end positions in which said first transfer member is respectively nearer to and more distant from the outermost sheet of the stack; a hold-down device connected to said first transfer member for movement therewith and engaging the outermost sheet of the stack at a spacing from a marginal portion thereof in said first end position of said first transfer member; a second transfer member; means for turnably mounting said second transfer member on said first transfer member for movement between a first position and a second position; at least one sheet attracting member mounted on said second transfer member and being adjacent to and attracting said marginal portion of the outermost sheet of the stack in the first position of said second transfer member, said attracting member moving along an arcuate path away from the stack in response to movement of said second transfer member to said second position whereby said marginal portion of the outermost sheet is flexed in a direction away from the neighboring sheet of the stack about said hold-down device; means for moving said second transfer member between said first and second positions; and means for moving said first transfer member, together with said second transfer member and said hold-down device, from said first to said second position while said second transfer member is out of said first position, whereby said hold-down device is spaced from the stack and hence releases the outermost sheet for movement away from the stack with said first transfer member for completion of separation of the outermost sheet from the neighboring sheet during the movement of said first transfer member toward said second end position.

12. Apparatus as defined in claim 11, wherein said mounting means defines a pivot axis for said second transfer member and said hold-down device is closely adjacent to said pivot axis.

13. Apparatus as defined in claim 11, wherein said hold-down device is integral with said mounting means for said second transfer member.

* * * * *